United States Patent [19]

Wallace et al.

[11] 4,144,801

[45] Mar. 20, 1979

[54] METHOD AND APPARATUS FOR TRANSPORTING AND HOUSING TUNNEL WORKERS ACTIVE IN HIGH PRESSURE ENVIRONMENTS

[75] Inventors: Kenneth W. Wallace, Gretna; Anthony V. Gaudiano, Metairie, both of La.

[73] Assignee: Taylor Diving & Salvage Co., Inc., Belle Chasse, La.

[21] Appl. No.: 843,968

[22] Filed: Oct. 20, 1977

[51] Int. Cl.[2] ..... E21F 5/00

[52] U.S. Cl. ..... 98/1.5; 98/49; 128/204; 105/314; 114/312; 405/192; 405/193

[58] Field of Search ..... 98/1, 1.5, 49, 50; 61/69 R, 82, 69 A, 81; 105/314, 329 R; 114/16 R; 128/204, 298

[56] References Cited

U.S. PATENT DOCUMENTS

| | | | |
|---|---|---|---|
| 3,316,828 | 5/1967 | Boehmer | 128/204 |
| 3,548,516 | 12/1970 | Lanphier et al. | 61/69 R |
| 4,011,867 | 3/1977 | Arntzen | 98/1.5 |

*Primary Examiner*—Henry C. Yuen
*Attorney, Agent, or Firm*—Kenway & Jenney

[57] ABSTRACT

A method and apparatus for increasing the safety and productivity of tunnel workers active in high pressure environments is disclosed. The workers are housed at an intermediate pressure over a "work week" of at least several days and are transported between the tunnel face and the life support chamber in which the workers are housed in a pressurized personnel transport chamber. The housing contains sanitary, sleeping, decompression, storage and dining facilities and is generally located at the tunnel entrance. In the preferred embodiment, the intermediate pressure is about half of the tunnel working pressure but not more than about 20 psig and preferably less than 17 psig. It is expected that a decreased incidence of bone related diseases and bends will result due to the reduced number of full decompressions from the tunnel work environment.

12 Claims, 2 Drawing Figures

METHOD AND APPARATUS FOR TRANSPORTING AND HOUSING TUNNEL WORKERS ACTIVE IN HIGH PRESSURE ENVIRONMENTS

This invention relates to a method and apparatus for increasing the safety and work output of persons working in a tunnel having a high pressure environment, and in particular to a method and apparatus for housing workers at a pressure intermediate the tunnel pressure and atmospheric pressure and for transporting them between tunnel work area and the housing structure.

BACKGROUND OF THE INVENTION

Tunnel workers often engage in activities in a high pressure environment, for example, a tunnel extending beneath a body of water or a tunnel extending into and through a mountain. Tunnel pressures in these environments often range as high as about 50 psig; and at pressures above about 11 psig, the tunnel workers are typically subjected to a daily compression/decompression cycle between tunnel pressure and atmospheric pressure.

Tunnel workers, whether they work in a high pressure environment or not, typically follow a similar schedule. They work an eight hour shift; and if they are working at high pressures, a portion of the shift is spent in compressing from atmospheric pressure to the working pressure and another portion of the shift is spent in decompressing from the effects of high pressure according to readily available schedules or tables. However, repeated full decompression after each work period is time consuming, may provide the worker with a psychological crutch tending to promote absenteeism, and necessarily limits the effective work output per man-day by limiting the number of working hours per "eight hour work day". In addition, repeated full decompression exposes the worker to a higher incidence of the bends and is believed to result in a higher incidence of bone related diseases, for example, osteonecrosis bone neurosis.

By borrowing from deep water diving technology, one might have expected that the effects of repeated full compression/decompression cycles could be successfully avoided. That technology teaches that the worker should be maintained at or near the high pressure found at the work area for an extended period of time, including non-work or "rest times". However, these diving systems have generally been directed to work activities at a depth of up to 1000 feet or more, where working pressures may be as great as 400 or more psig. Thus, while such systems have proven feasible and successful in connection with deep water projects, they still provide a relatively long decompression time when the worker leaves the pressure system because a full decompression from substantially the working pressure is still required. Thus the tendency to have adverse reactions such as the bends and increased incidence of bone related disease persists. The problem is compounded because the tunnel worker, unlike the diver, does not "stay under" until the job is done. Instead, he continues to work substantially his usual "work week". Additionally divers generally work in small groups, three to six man crews, whereas tunnel workers typically work in larger groups, for example, crews of twelve men or more.

Consequently, the problem of repeated substantially full compression/decompression from tunnel work areas having high pressure environments remains and workers must either engage in work activities at high pressures less often or ignore the problems of repeated substantially full compression/decompression.

It is therefore a principle object of this invention to provide a method and apparatus for allowing tunnel workers to engage in high pressure work activities without subjecting them to the increased risk of bone related disease. Other objects of the invention are to provide an efficient work structure whereby tunnel work in a high pressure environment may continue on a twenty-four hour basis, if desired, to increase work productivity, to provide apparatus which is relatively simple in structure and easy to maintain, to provide comfortable rest facilities for the tunnel workers, and to provide reliable apparatus capable of performing its function over long periods of time.

A further object of the invention is to avoid a substantially full decompression from the tunnel pressure.

SUMMARY OF THE INVENTION

The invention relates to a method and apparatus for transporting and housing tunnel workers working in a tunnel work area having a high pressure environment. The method features the steps of housing the workers during non-work hours, over a plurality of working days, in a pressurized chamber maintained at an intermediate pressure less than the high pressure of the work area and greater than atmospheric pressure, and transporting the workers between the higher pressure work environment (or tunnel face) and the pressurized chamber in a pressurized personnel transport chamber.

In preferred embodiments of the method, the intermediate pressure in the pressurized chamber is often less than about 20 psig and preferably less than about one-half the pressure at the work area, and the pressure in the pressurized transport chamber may be changed or varied between the intermediate pressure and the high pressure during the transporting step.

The apparatus according to the invention features a pressurized life support chamber to house the workers for a plurality of days during non-work hours and pressure maintaining apparatus for maintaining the life support chamber at an intermediate pressure greater than atmospheric pressure and less than the high pressure of the work area. Also featured is a pressurized vehicle means to transport the workers between the life support chamber and the work area. The pressurized means and the life support chamber each have a connection means adapted to form a pressure tight seal between the chamber and the vehicle. In this way workers can transfer between the chamber and the vehicle and the ambient pressure of the chamber is maintained and is unaffected by the connection of the vehicle. The pressurized vehicle means and the work area each also have means to connect the vehicle to the work area to form a pressure tight seal between the work area and the vehicle. Thus the ambient pressure of the work area is maintained and is unaffected by the connection, and workers can transfer between the work area and the vehicle.

In a preferred embodiment, the invention further features means associated with the pressurized vehicle to change the pressure in the vehicle in a controlled manner between the intermediate pressure and the work area pressure.

DESCRIPTION OF THE DRAWINGS

Other objects, features and advantages of the invention will appear from the following description of a preferred embodiment taken together with the drawings in which.

DESCRIPTION OF A PREFERRED EMBODIMENT

According to the invention, a pressurized housing unit is provided, at a relatively low pressure which avoids the detrimental effects of repeated full compression/decompression. By housing the workers at a relatively low, intermediate pressure for an entire "work week", they soon become "saturated" at the intermediate pressure. Furthermore, even though the intermediate pressure is low, only relatively short compression/-decompression times, if any are required, are needed during the excursions to and from the higher tunnel pressure. These excursions to and from the higher pressure are insufficient to cause bends or bone related disease and are short enough so that compression and decompression, if necessary, can be easily scheduled to take place during transport in a pressurized transporting vehicle. Furthermore, when a worker leaves the system, decompression from the "saturation" or intermediate pressure requires less time than decompression from the tunnel pressure, and more importantly, if the "saturation" or intermediate pressure is less than about 11 psig, it is believed that no decompression will be necessary.

Figure 1:
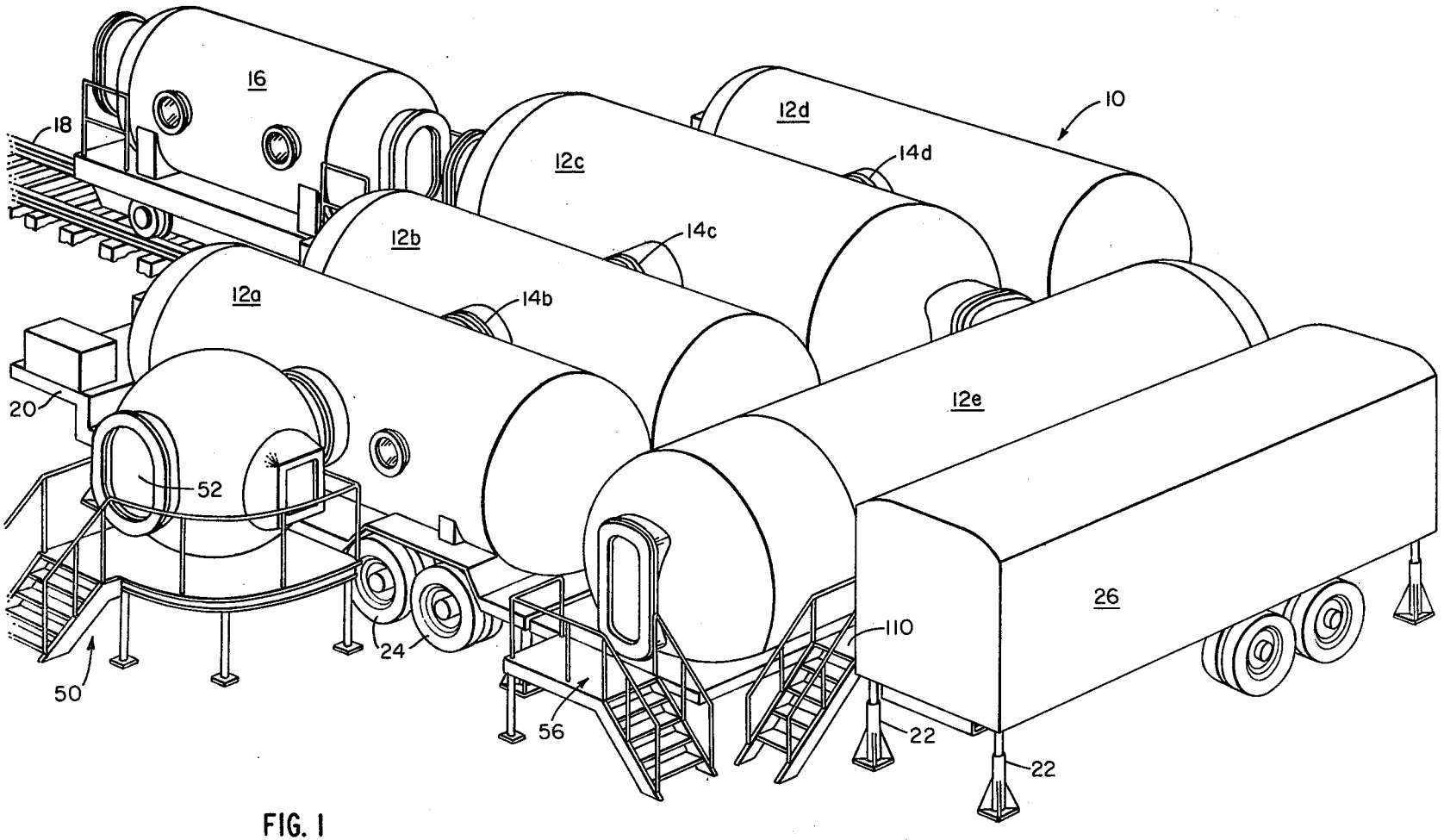
FIG. 1 is a perspective view of the life support chamber and pressurized vehicle means according to a preferred embodiment of the invention.

Referring to FIG. 1, the invention includes a human occupancy pressure vessel (HOPV) 10, which is a life support chamber comprised of a plurality of individual pressurized tanks 12*a*, 12*b*, 12*c*, 12*d*, 12*e* interconnected by a plurality of air locks 14*a*, 14*b*, 14*c*, 14*d* (See FIG. 2), and a personal transfer chamber 16, a pressurized transport vehicle designed, in the preferred embodiment, to transport workers between vessel 10 and the tunnel face of a work area (not shown) along tracks 18.

Each of the pressurized tanks 12 is mounted on a mobile carrier 20 for easy transit from one working location to another. Typically the tanks 12 are positioned at or near the entrance to the tunnel and are raised on jacks 22 to decrease wear of tires 24 and to level the tanks. A control facility 26, at atmospheric pressure, is also provided on a mobile carrier for easy transport between work sites. The control facility provides the necessary communications with the vessel 10, safety monitoring and control equipment to maintain proper pressures in the vessel, control over decompression when needed, scheduling of various functions for the system, and any other required control function.

Figure 2:
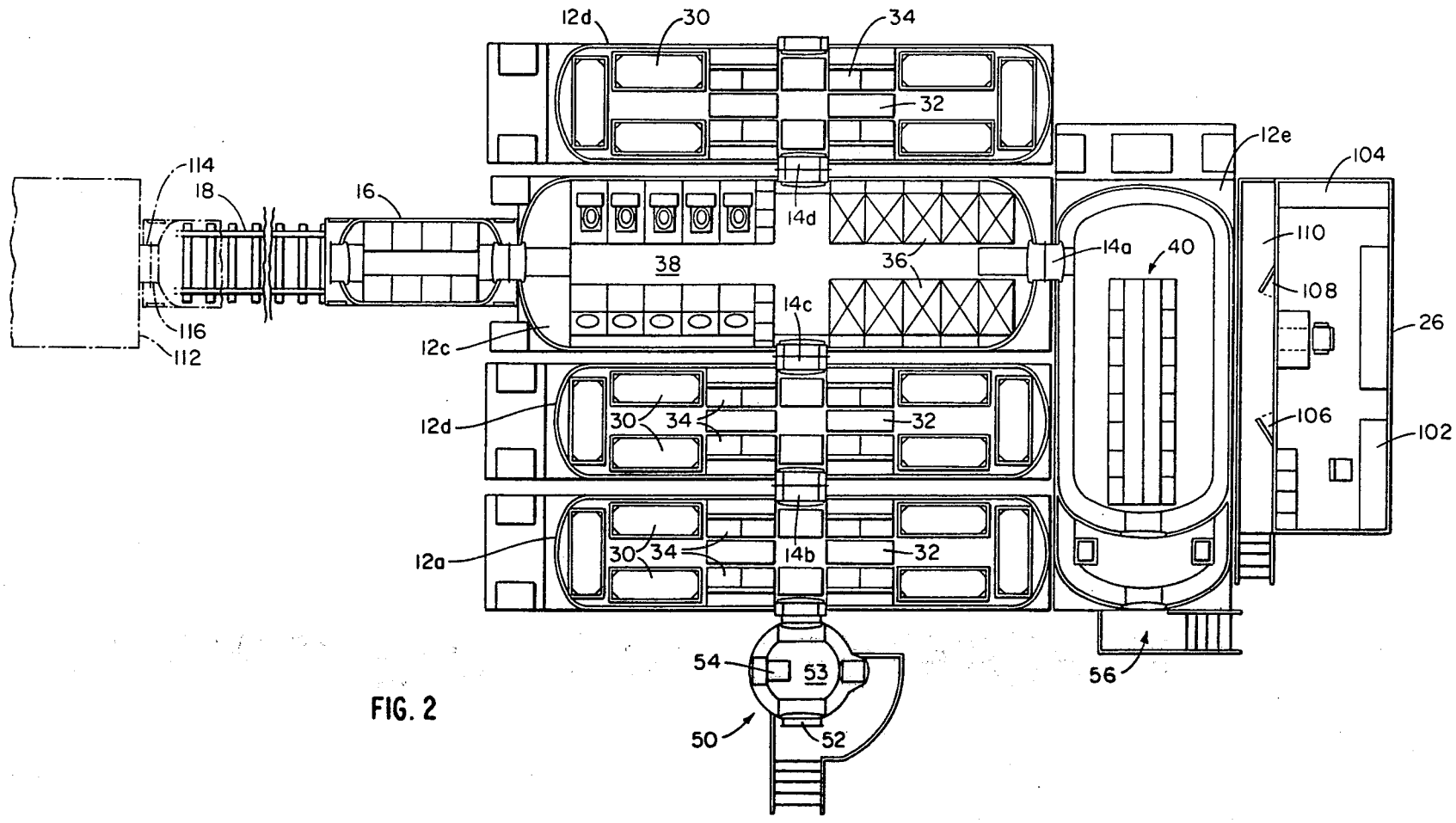
FIG. 2 is a plan view of the life support chamber and the pressurized vehicle means according to a preferred embodiment of the invention.

Referring to FIG. 2, according to the preferred embodiment, the human occupancy pressure vessel comprises two storage and sleeping chambers, tanks 12*b* and 12*d*, a storage/decompression chamber, tank 12*a*, a sanitary chamber, tank 12*c*, and a dining and recreation chamber, tank 12*e*. The storage and sleeping chambers are identical in design and are identical with the storage/decompression chamber, tank 12*a*. Each of these chambers has a plurality of beds 30 (6 two level bunk style beds are shown), tables 32, and lounge chairs 34. The pressure in the storage/decompression chamber, tank 12*a*, can be separately controlled by control facility 26 to effect a proper decompression schedule for workers who have completed their stay in the HOPV. In other embodiments of the invention, it may be desirable or necessary to change the configuration, number, or function of the tanks 12, for example, to provide each storage/sleeping chamber, or the entire chamber 10 with the capability of going through a decompression cycle.

The sanitary chamber, tank 12*c*, includes means 36 for showering and all washroom facilities 38. The dining and recreation chamber, tank 12*e*, includes a table and chairs 40, and the various implements, dishes, and other equipment which a kitchen area would require.

The HOPV 10 has, in the preferred embodiment, two entrances. The main entrance to the vessel 10, vessel entrance 50, is through an entrance air lock 52. The entrance area 53 is equipped with toilet facilities 54 for use by workers in tank 12*a* who are undergoing a decompression cycle as described in more detail below. The second entrance to the vessel, kitchen entrance 56, provides direct access to the dining area so that food and other provisions may be brought in without passing through the living quarters of the HOPV.

The operation and control of the HOPV is directed from the control facility 26 located near the HOPV. As noted above, facility 26 is not required to be maintained in a high pressure environment. The control facility is electrically connected to the HOPV and maintains the proper pressure and electrical requirements in the HOPV. An isobaric decompression control 102 is provided to properly control decompression in tank 12*a* at the end of a "work week". A computer apparatus 104 is provided to maintain and monitor atmosphere and pressure and all other functions within the HOPV in order to insure proper safety for the men therein. A manual instrumentation control console 106 is provided whereby a single operator may monitor and manually control all functions within the HOPV.

Entrance to the control unit is provided along entrance ways 106, 108 leading from cat walk 110. The control chamber itself is generally an air-conditioned room in order to maintain temperature stability of the equipment therein.

The HOPV disclosed in the preferred embodiment is designed to house thirty-six men for a substantial period of time. The thirty-six men would typically be divided into three twelve man crews, each crew working an eight hour shift. In this way, work can continue in the tunnel on a twenty-four hour basis if desired.

If it is desired to have work continue at the tunnel twenty-four hours a day, seven days a week, one possible work schedule would provide for five twelve man crews, each crew working for six days, then resting for four days. The "on time" would be staggered so there would never be more than three crews in the HOPV at any one time. Other applications may require larger or smaller crews having the same or different work schedules.

According to the preferred embodiment, a first twelve man crew, crew A, would begin by entering the lock at the face of the work area at day one, hour one. They undergo pressurization (compression) as is currently done, as is well known in the art, and work a normal shift of a total of eight hours. At the end of the shift, they would proceed to the face of the tunnel and enter the personnel transport chamber 16 which will transport them to the HOPV at the surface. The personnel transport chamber and the tunnel face 112 each have connections 114, 116 which when mated form an air tight seal and pressure lock. The pressure in the transport chamber is equalized if desired or necessary to the pressure at the tunnel face so that the workers may freely pass between the tunnel face and the transport chamber. As the transport chamber travels between the tunnel face and the HOPV, the workers may be decompressed to the storage pressure in HOPV 10. This may typically take one hour or less. If decompression is not necessary because the duration of the excursion to the higher pressure was sufficiently short, no decompression during transport will occur.

Upon arrival at the HOPV, the personnel transport chamber is connected to tank 12*c*, the sanitary chamber. Coupling is effected by connections on the transport chamber and the HOPV which together form an air tight seal and pressure lock. By the time the transport chamber reaches the HOPV, its pressure is preferably equal to HOPV pressure and the workers may freely pass into the HOPV. In the HOPV, the crew typically first showers, changes, and then proceeds to the dining chamber, tank 12*e*. Since crew A will be decompressed first (they were the first to begin), they will occupy the storage/decompression chamber, tank 12*a*, during their "work week". This sequence of events is repeated for crew B (starting at hour 9) and crew C (starting at hour 17) except that they occupy the storage and sleeping chambers, tanks 12*b* and 12*d* respectively.

On the twenty-third hour of the first day, crew A is transported back to the tunnel face in the personnel transport chamber to relieve crew C. The sequence continues in this manner until the decompression of crew A from the intermediate pressure begins.

Decompression of crew A which normally starts after the sixth work period, begins on the second day for the first "work week" only. This allows the proper rotation of crews in the decompression chamber. Decompression starts immediately after the crew returns from the tunnel face. During the time required to decompress from the HOPV intermediate pressure to atmospheric pressure, the storage/decompression chamber, tank 12*a*, is sealed from the rest of the vessel. Meals are provided to the crew through the main entrance 50. The sanitary facilities 54 of entrance 50 are also accessible to the crew. When decompression is completed, crew A leaves the vessel 10, and a new crew, crew D, takes crew A's place in the tunnel. Crew D will work the full six day "week".

The decompression chamber will be occupied by crew B when they return from their shift on the third day of the week and decompression of crew B begins after their work shift on the fourth day. A fifth crew, crew E, replaces crew B after decompression. Crew C occupies the tank 12*a* for decompression beginning on the fifth day of the week and begins decompression after their work shift on the sixth day. In this way a work schedule is designed to accommodate sequential change of crews so that work never stops in the tunnel. A new crew goes "under" every two days, when the oldest one decompresses.

The number of crews and the hours they work can be arranged to meet whatever schedule is desired or needed. In the disclosed embodiment, each crew works for six days and is then off for four days. In addition, the crews rotate shifts, that is, a crew that works the first shift one "week", will work the third shift during the next "work week".

Typically the pressures at the tunnel work area may be as high as 50 psig. It is believed that the HOPV should typically operate at a pressure approximately half the tunnel pressure, but not greater than about 20 psig, preferably less than about 17 psig, and more desirably less than about 11 psig. It is believed that at HOPV pressures less than 11 psig, no decompression is necessary to leave the HOPV and at pressures less than 17 psig, the occurrence of bone related disease as a result of decompression is eliminated.

MAJOR ADVANTAGES AND UNOBVIOUSNESS OF THE INVENTION

The invention is directed to a novel and non-obvious method and apparatus for transporting and housing tunnel workers who work in a high pressure tunnel environment. It provides a practical solution to the problem of increasing worker production while maintaining acceptable and satisfactory working and housing conditions. The method and apparatus depart significantly from the practices used in deep sea diving operations wherein divers are maintained substantially at the working pressure. In the claimed invention, the divers are housed and become saturated at a relatively low intermediate pressure, a pressure at which the risk of decompression sickness and the incidence of bone related disease is believed to be minimal (See e.g., Behnke and Jones, Preliminary BART Tunnel Results, In: Beckman, E. L. and D. H. Elliott, eds. Dysbarism-related osteonecrosis. Proceedings of a symposium of dysbaric osteonecrosis, Marine Biomedical Institute, University of Texas Medical Branch, Galveston, Tex., February, 1972, p. 25–40).

The invention thus provides a method and apparatus for reducing the incidence of bone related disease and the bends due to repeated full decompression from tunnel pressures. The invention further advantageously provides a method and apparatus for working a tunnel which has a high pressure environment on a twenty-four hour basis, seven days a week, with a minimum number of men and maximum efficiency.

The method and apparatus further advantageously provide sufficient rest and recreation facilities for successfully satisfying the psychological needs of tunnel work crews engaged in activities in high pressure environments. The method and apparatus of the preferred embodiment of the invention further advantageously provide apparatus which is mobile and which can be moved from one location to another with relative ease and facility.

Other embodiments of the invention, including different constructions of the apparatus, will occur to those skilled in the art and are within the following claims.

What is claimed is:

1. Apparatus to house and transport tunnel workers engaged in work in a tunnel work area having a high pressure environment, said pressure being sufficiently high to require that decompression procedures be employed to return the workers to an atmospheric pressure environment at the end of a work day comprising a pressurized life support chamber to house said workers over a plurality of working days, during non-work hours, a pressure maintaining apparatus for maintaining said life support chamber at an intermediate pressure greater than atmospheric pressure and less than said high pressure, a pressurized vehicle means to transport workers between said life support chamber and the work area, said pressurized vehicle means and said life support chamber each having a connection means adapted to form a pressure tight seal between said chamber and said vehicle means whereby workers can transfer between said chamber and said vehicle means, and said pressurized vehicle means and a tunnel face each having second connection means to form a pressure tight seal between the tunnel face and the vehicle means whereby workers can transfer between said vehicle means and said tunnel face.

2. The apparatus of claim 1 further including means associated with said pressurized vehicle means to change the pressure in said pressurized vehicle means between the pressure at the tunnel face and the intermediate pressure.

3. The apparatus of claim 1 wherein said life support chamber includes means for providing sleeping facilities for said workers, means for providing eating facilities for said workers, means for providing sanitary facilities for said workers, a decompression facility for said workers, and said plurality of days number at least four.

4. The apparatus of claim 1 wherein said life support chamber includes a plurality of pressurized tanks, said tanks being interconnected by a plurality of air locks to provide access from one tank to another, a pressure control means for separately controlling the pressure in said tank, at least one of said tanks having sleeping facilities, at least one of said tanks having eating facilities, at least one of said tanks having sanitary facilities, and at least one of said tanks having a decompression cycling means.

5. The apparatus of claim 2 wherein said pressurized vehicle means is a motorized vehicle for use on tracks.

6. The apparatus of claim 1 wherein said intermediate pressure is less than about 20 psig.

7. The apparatus of claim 1 wherein said intermediate pressure is less than about 17 psig.

8. The apparatus of claim 1 wherein said intermediate pressure is less than about 11 psig.

9. The apparatus of claim 1 wherein said intermediate pressure is about half the pressure in the work area.

10. Apparatus for housing and transporting tunnel workers for a plurality of days wherein said workers are engaged in activities in a tunnel work area having a high pressure environment comprising a pressurized life support chamber to house said workers during non-working hours, a pressure maintaining apparatus for maintaining the life support chamber at an intermediate pressure greater than atmospheric pressure and less than the high pressure of the tunnel environment, a pressurized vehicle means to transport the workers from the life support chamber to a tunnel face, the pressurized means comprising a pressurized chamber mounted on a wheeled base, the wheeled base being adapted to run on tracks, the pressurized vehicle means and said life support chamber each having connection means for forming a pressure tight seal between the chamber and the vehicle means whereby workers can transfer between said chamber and said vehicle means, the pressurized vehicle means and the tunnel face each having second connection means to form a second pressure tight seal between said face and said pressurized vehicle whereby workers can transfer between said vehicle means and said work area, and the life support chamber being comprised of a plurality of separate pressure tight tanks interconnected by a plurality of air locks.

11. The apparatus of claim 10 further including a pressure changing means associated with the pressurized vehicle means to change the pressure in the pressurized vehicle between the intermediate pressure and the high pressure of the tunnel.

12. The apparatus of claim 10 wherein said life support chamber is mounted on a wheeled carrier for transport from one tunnel entrance to another.

* * * * *